US006954947B1

(12) United States Patent
Williams, Jr.

(10) Patent No.: US 6,954,947 B1
(45) Date of Patent: Oct. 18, 2005

(54) PLUMING VENT COVER

(76) Inventor: Marvin J. Williams, Jr., P.O. Box 96, New Buffalo, MI (US) 49117

( * ) Notice: Subject to any disclaimer, the term of this patent is extended or adjusted under 35 U.S.C. 154(b) by 0 days.

(21) Appl. No.: 10/832,805

(22) Filed: Apr. 27, 2004

(51) Int. Cl.[7] ..... E03D 9/04
(52) U.S. Cl. ..... 4/218; 454/366; 454/368
(58) Field of Search ..... 454/4, 7, 35, 348, 454/362, 365, 366, 368; 4/211, 218

(56) References Cited

U.S. PATENT DOCUMENTS

| | | | | | |
|---|---|---|---|---|---|
| 293,526 | A | * | 2/1884 | Scholl | 454/3 |
| 421,098 | A | * | 2/1890 | Harrington | 454/4 |
| 1,340,033 | A | * | 5/1920 | Fojtik | 454/35 |
| 1,452,259 | A | * | 4/1923 | Snell | 220/324 |
| 2,695,554 | A | * | 11/1954 | Jenson et al. | 454/35 |
| 3,022,717 | A | * | 2/1962 | Webster | 454/4 |
| 3,200,735 | A | * | 8/1965 | Bergen | 454/366 |
| 3,398,671 | A | * | 8/1968 | Acosta | 454/36 |
| 3,700,381 | A | * | 10/1972 | Deeke | 4/288 |
| D259,208 | S | | 5/1981 | McCullough | |
| 4,372,585 | A | | 2/1983 | Evora | |
| 4,543,754 | A | * | 10/1985 | Cekala | 52/218 |
| 5,010,700 | A | | 4/1991 | Blair | |
| 6,015,343 | A | | 1/2000 | Castillo et al. | |
| D428,130 | S | | 7/2000 | Zirk | |
| D428,484 | S | | 7/2000 | Zirk | |
| 6,183,360 | B1 | | 2/2001 | Luter, II et al. | |
| 6,286,273 | B1 | | 9/2001 | Villela et al. | |
| 6,447,392 | B1 | | 9/2002 | Henderson | |
| 6,484,712 | B1 | | 11/2002 | Lyons et al. | |
| 6,508,704 | B1 | | 1/2003 | Wilson | |
| 6,612,924 | B1 | | 9/2003 | Mantyla et al. | |
| 6,705,052 | B1 | | 3/2004 | Larson | |
| 6,773,342 | B2 | * | 8/2004 | Rotter | 454/365 |
| 2003/0054754 | A1 | | 3/2003 | McKee | |
| 2003/0104779 | A1 | | 6/2003 | Marts et al. | |

OTHER PUBLICATIONS

Initial prototype, second prototype, Exhibit A, Attached sheets.

* cited by examiner

*Primary Examiner*—Harold Joyce
(74) *Attorney, Agent, or Firm*—Adrienne B. Naumann

(57) ABSTRACT

A pluming vent cover is described herein which is easily manufactured and adapted to a roof on or off-site. A roof's pluming vent pipe requires a cover for both aesthetics and improved operation. In the preferred embodiment the pluming vent cover comprises an upper pyramidal cap, two rounded metal straps and a cone-shaped base. The operator can trim the lower ovoid continuous edge of the cone-shaped base to conform to the slope and pitch of the roof, shingles, or both. A method for producing this pluming vent cover is also described.

15 Claims, 5 Drawing Sheets

FIG.3
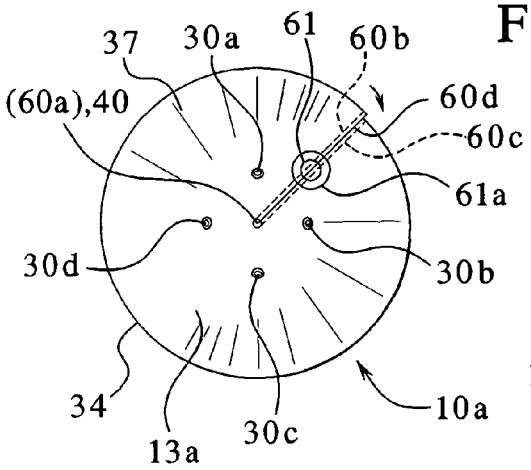
FIG.4
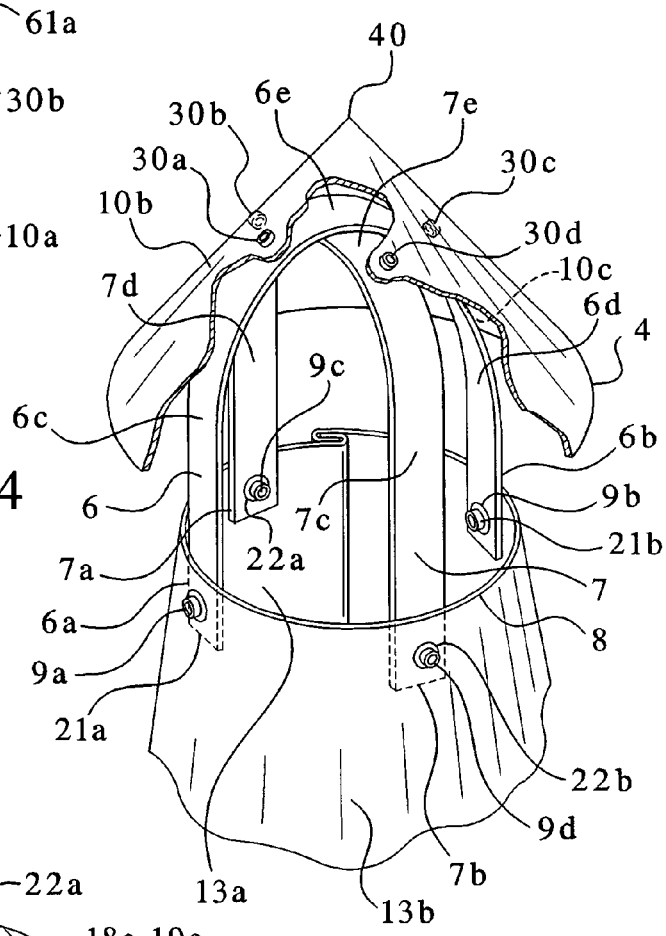
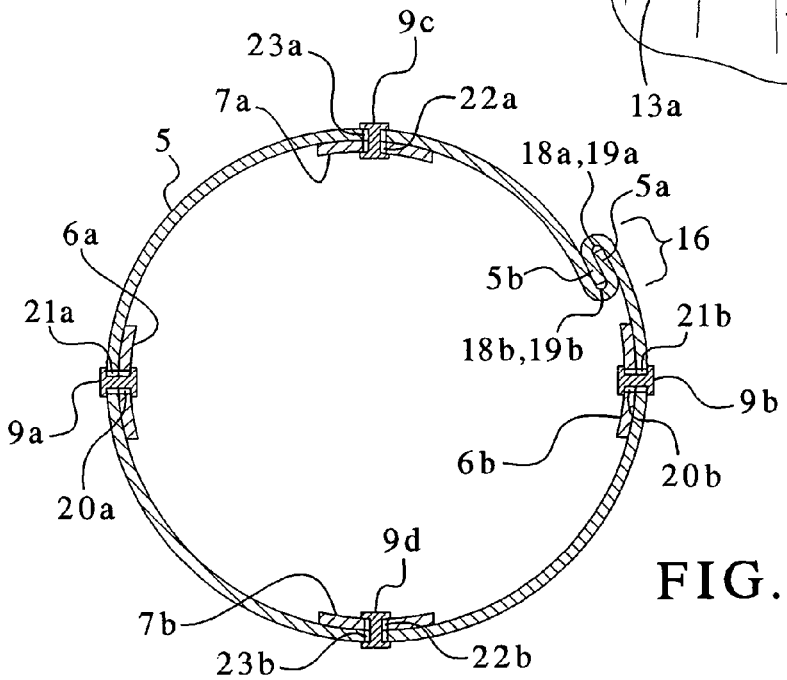
FIG.5

PLUMING VENT COVER

BACKGROUND OF THE INVENTION

My invention generally relates to a cover for vents which protrude from the exterior surface of building roofs. In particular this invention relates to a cover for a gas pluming vent which is custom shaped either on or off-site to conform to the slope and pitch of a particular roof. My pluming vent cover can be a three component device, with a lowermost base, a middle component which covers the pipe comprising the pluming vent, and a third component which forms an elevated cap. However, my preferred pluming vent cover comprises a cone-like base and an upper pyramidal cap.

My pluming vent cover is preferably made by (i) initially severing and folding a stiff steel or copper sheet to form a modified cone; and (ii) cutting and folding the cap. Preferably my pluming vent cover also comprises one longitudinal hem along the cone shaped base. The two edges forming the hem folds back upon themselves and remain in the folded position, because of the stiffness of the metal sheet. Two intersecting straps attach to the top of the cone-shaped base with pop rivets; pop rivets also fasten the small cap to the straps' respective central mid-lines.

As discussed infra, the prior art does not disclose a rigid pluming vent cover which does all of the following simultaneously:

(i) prevents rains and elements from entering the roof through the pluming vent, (ii) provides a more attractive appearance than a conventional vent pluming pipe, or (iii) is easily custom fit on site along its lower edge to conform to the pitch and slope of a particular roof, as well as to the number or thickness of roof tiles.

For example, U.S. Pub. No. U.S. 2003/0054754 (McKee) discloses a passive venting device which comprises a base member and an attachment portion. There is also a vent structure for gas and other vapors to pass, as well as a cover mounted to the base, to permit gas and vapor to the outside. There is a baffle which obstructs precipitation from the roof exterior, as well as a ventilation pathway spaced from the roof. This path allows installation of thick shingles or tiles on a roof, which abut the device without interfering with ventilation. However, the baffle is not necessarily aesthetically pleasing, and the bottom edge is not custom-shaped to fit the roof's slope and pitch quickly on or off-site.

U.S. Pub. No. U.S. 2003/0104779A1(Marts et al.) discloses a security cover for a ventilation duct. This apparatus prevents solid, liquid or gaseous material from entering the vent. Several baffles form a convoluted path for materials entering or leaving the vent. However, this security cover does not necessarily cover all heights of plume vent pipes and cannot be shaped to fit a specific slope and pitch of a particular roof.

U.S. Pat. No. 5,010,700 (Blair) discloses a roof jack which has a planar roof covering with a central upstanding frusto-conical section. This conical section includes stepped graduated portions, with the region between each graduated portion flexing to accommodate differences in roof pitch. The entire device is made of polypropylene-synthetic rubber polymer and is produced by a single vacuum formed operation. However, there is no provision for a stiff rigid cover which is custom fit on or off-site along a bottom edge to fit a specific roof slope and pitch.

U.S. Pat. No. 6,612,924 (Mantyla et al.) discloses a passive venting device for a building which comprises a base with a vent for gases to and from the building. There is also an attachment coupled to the vent and a gas permeable screen to prevent objects from passing through the vent. The gas permeable screen is spaced from the attachment structure vertically away from the roof.

U.S. Pat. No. 6,705,052 B1 (Larson) discloses a soffit vent comprising a base with opposing elongated edges and a pair of parallel flanges extending upwardly. There is a vent zone in the base and attachment flanges formed by portions of the base. U.S. Pat. No. 6,447,392 (Henderson) discloses a one-sided roof vent with two ends. One end has a base cross section while the second end has a thickness of at least twice that of the base cross section. An optional pivot point permits the device to conform to the structure, along with a baffle or cover filer to prevent entry by environmental particles.

U.S. Pat. No. 6,508,704 B1 (Wilson) discloses an air vent apparatus for lighting devices. A staked chevron is symmetrically located within the air vent housing of the device. Numerous variations in the length of chevron vanes, vane angle and the pitch function are for a optimal vent for articles such as movie projects, arc lamps, and laser devices. However, this device is not a functional vent cover which is quickly custom-shaped on or off-site to fit the slope or pitch of a specific roof.

U.S. Pat. No. 6,484,712 B1 (Lyons et al.) discloses a vent cover assembly with a vent cap covering the vent apertures and an assembly extending around the vent cap and vent. In one embodiment the protective structural features allows air flow into and from the vent cap. In another embodiment, there is an attachment base with semi-cylindrical parts which connect to the attachment base. The base is made of sheet metal or other flame-retardant materials.

U.S. Pat. No. 4,372,585 (Evora) discloses a sleeve protector for venting pipes. It contains a tube attached at one end to a flat portion at the angle which follows the roof slope. There is also a protector cap mounted on the other end of the tube with annular spaced clamps which attach to ribs on the outside tube wall. The sleeve protector is installed by placing the hollow cylinder portion over the pipe. The attached flat portion protects against leaks in areas where the roof and pipe meet. Then the cap member inserts inside the pipe as completely as possible. Clamps interlock with the ribs, thereby protecting the pipe against accidental or intentional tampering.

U.S. Pat. No. 6,286,273 B1 (Villela) discloses a tile vent which covers the opening of an undulating roof ridge. The tile vent includes vent slots for air exhaust, as well as reinforcing stiffeners to support ridge tiles places over the ridge opening. The tile vent includes two integral panels which oppose each other, with the top portion of each panel attached to a ridge board and the bottom portion attached to the actual roof. U.S. Pat. No. 6,015,343 (Castillo et al.) discloses a similar tile roof vent which covers the ridge opening of an undulating tile roof. The vent in this invention includes two opposing panels, and each panel comprises a hard plastic sheet, each with an upper portion and a lower portion. The underside of the lower portions each attach to an air permeable mat. The lower portions are also reinforced by stiffeners and contain vent holes for exhausting air.

Design patents for roof vent covers disclose what appear to be non-functional embossed or raised designs on what appear to be either the pluming vent cover or the pluming vent pipe. For example, Des. 428,130 (Zirk) discloses a copper roof vent cover with what appears to be a cap which rests directly upon either the actual vent pipe. Des. 428,484 (Zirk) also discloses a copper roof vent cover which has a circular ornamental design as an integral part of the roof cover. Des. 259,208 (McCullough) discloses an ornamental design for a roof vent, but the design is apparently an integral decorative feature of the actual vent and not a separate roof vent cover per se. These features add no specific function to the vent covers, unlike my pending invention.

In addition to the preferred embodiment, in other embodiments my pluming vent cover conceals other kinds of roof vents on commercial as well as residential structures. In still other embodiments my pluming vent cover conceals sewer pipes and other protruding pipes and vents of diverse structures.

SUMMARY OF THE INVENTION

The present invention comprises an integral pluming vent cover with two rounded metal straps, an upper pyramidal cap and a cone-shaped base in the preferred embodiment. The present invention also comprises the method by which a visually attractive pluming vent cover is custom cut and folded into the appropriate shape either on-site or off-site. In the preferred embodiment, the initial stiff but bendable steel or copper sheet is severed and then folded into a pluming vent cover for any roof pitch, slope, tiles, or dimensions and shapes of pluming vent pipes. In addition to low materials and labor cost, as well as on-site custom fits, my pluming vent cover conceals the unattractive common plume vent pipe, its rubber flashing and base, which are routinely installed upon residential building roofs.

Currently on pluming vents, a flashing seals the interface between the pipe and the roof with a rubber washer and steel or plastic base, and the entire assembly creates an unsightly appearance. This result occurs is because the residential pluming vent is generally three different colors which differ from the color of the roofing materials. The actual pluming vent pipe is often painted black to camouflage the unsightly pipe, washer and base from the casual observer. Unfortunately, this paint exposed to the weather eventually cracks and peels, leaving the pluming vent even more unsightly.

For steel roofs, my pluming vent cover is preferably fabricated from a flat steel sheet for a consistent and attractive appearance. The flat steel sheet is initially marked or scored for cutting and bending into a cone-shaped base with one longitudinal hem. In my preferred embodiment, the pluming vent cover forms an approximate cone-shape from the metal sheet with an additional sheet hooked to either side. After my pluming vent cover is riveted to two rounded straps and a cap, it is placed over the pluming vent pipe. In other embodiments, my pluming vent cover comprises three components in addition to two rounded straps.

Each pluming vent cover is cut to roof specifications and caulked at all its points of contact with roofing shingles. The exact point at which each pluming vent cover is cut to fit each roof pitch is marked on the steel sheet, or other materials sheet, during cover construction, either on or of f-site. As roof pitches differ and roofing shingles each have their own slope, this base cut accounts for the slope. Preferably, the cut along the bottom ovoid continuous edge of the cone-shaped base is oval from the front to the posterior longitudinal hem at the cover posterior. The ovoid shape allows the cover to tightly abut the roof shingles.

In addition to the preferred steel or copper sheets, the roofer can use sheets with an embossed, raised, glazed, or enameled surface. Please see FIG. 11. In addition to a pleasing appearance, my pluming vent cover prevents the sun from drying the rubber washer which fits between the roof flashing and the polyvinyl chloride pluming vent pipe. My pluming vent cover has the added advantage of preventing rain, melting ice and snow from flowing into the pipe and then into the building. The pluming vent cover also prevents debris such as leaves and dirt from lodging within the pluming vent pipe and thereby preventing gas from escaping.

My pluming vent cover can also comprise panels which prevent snakes, insects and rodents from entering pluming vent pipes. These screens are cut from conventional window screen materials and fasten to the both the upper pyramidal cap and lower cone shaped base with small pop rivets 40. FIG. 11. In this embodiment my pluming vent cover is also effective for preventing small animals from entering sewer pipes.

Accordingly, it is the goal of this invention to provide a pluming vent cover which is economical to produce.

It is another goal of this invention to provide a pluming vent cover on or off-site which is easily adapted to closely fit the slope, pitch and shingles of each individual roof.

It is another goal of this invention to provide a pluming vent cover which prevents the sun from drying the rubber washer encircling the pluming vent pipe.

It is another goal of this invention to provide a pluming vent cover which prevents animals from entering crawl spaces within a building through a pluming vent pipe.

It is another goal of this invention to provide a pluming vent cover which prevents precipitation and debris from clogging the pluming vent pipe.

It is another goal of this invention to provide a pleasing aesthetic appearance to a pluming vent cover which camouflages the pluming vent pipe, washer and base.

It is another goal of this invention to provide a pluming vent cover which matches or complements the color and materials of the roof materials and/or shingles.

Another goal of my invention is to match the material used for the pluming vent cover with the same material which forms the roof.

These and other features and advantages of my pluming vent cover will become apparent in the attached figures and detailed description of the preferred embodiment and other embodiments, infra.

BRIEF DESCRIPTION OF THE DRAWINGS

FIG. 3 is a top plan view of the pyramidal cap of my preferred pluming vent cover.

FIG. 4 illustrates a cutaway isolated cone-shaped base portion of my pluming vent cover.

FIG. 5 illustrates a cross-sectional view of the upper portion of cone-shaped base through line V—V of FIG. 2.

DETAILED DESCRIPTION OF THE PREFERRED EMBODIMENT AND OTHER EMBODIMENTS

Introduction

Figure 1:
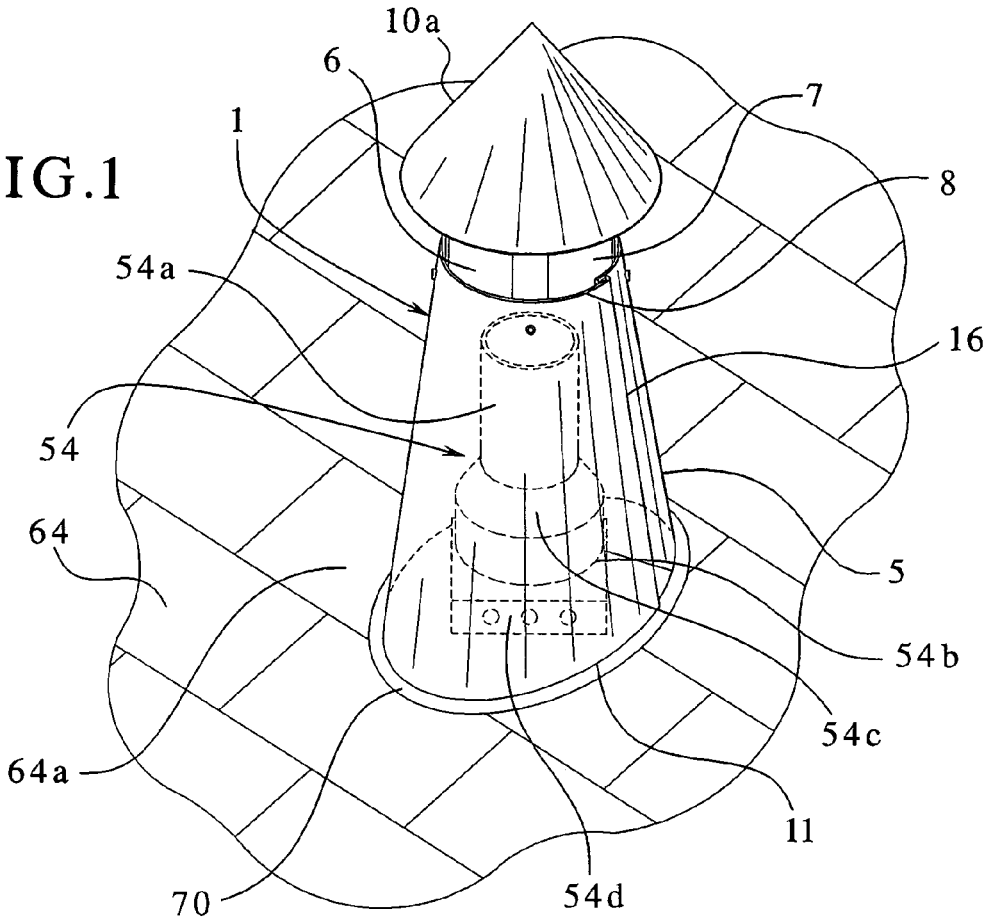
FIG. 1 illustrates partial perspective anterior view of my pluming vent cover attached upon a roof with caulk.

As seen in FIG. 1 of the preferred embodiment, my pluming vent cover 1 easily fits over a conventional pluming vent 54 located on either an angled or horizontal roof surface 64. A cone-shaped base 5 which is approximately 32 inches in diameter is required for a four inch plume vent pipe 54*a* which is approximately four inches in height.

Referring to FIGS. 1 and 4, preferred pluming vent cover 1 comprises a cone-shaped base 5. Attached to upper circular continuous edge 8 of cone-shaped base 5 are first and second rounded metal straps 6, 7 respectively. Strap 6 attaches by its first and second respective ends 6*a*, 6*b* to upper circular edge 8 with upper pop rivets 9*a*, 9*b*. Strap 7 attaches by third and fourth ends 7*a*, 7*b* respectively to upper circular continuous edge 8 with upper pop rivets 9*c*, 9*d* respectively (generically upper pop rivets 9). Each respective end 6*a*, 7*a* respectively opposes its counterpart 6*b*, 7*b* respectively at approximately 180 degrees along upper continuous circular edge 8.

Preferred pluming vent cover 1 also comprises a separate upper pyramidal cap 10*a* which forms a shallow rounded pyramidal cross-section with an apex 40. Upper pyramidal cap 10*a* is attached to each rounded strap 6, 7 by four pyramidal pop rivets 30*a*, 30*b*, 30*c*, 30*d* respectively (generically pyramidal pop rivets 30). Caps 10 of other shapes and sizes are also within the scope of my invention. Pluming vent cover 1 can be enameled, glazed, or bear an embossed design 75. Please see FIG. 11.

Figure 2:
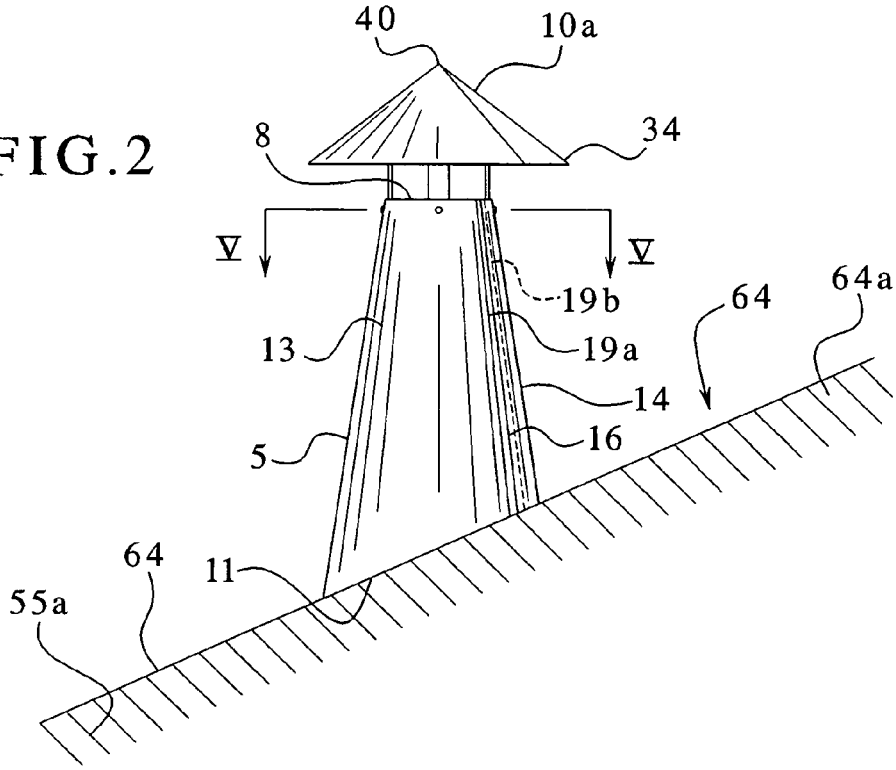
FIG. 2 illustrates a lateral view of my pluming vent cover attached to a roof, as well as the slope and pitch of the roof to which it conforms.

Referring to FIGS. 1 and 2, in the preferred embodiment cone-shaped base 5 forms a hollow approximate cone shape, which however, does not taper to a point but instead comprises a circular continuous upper edge 8. Cone-shaped base 5 is approximately eight inches in ovoid diameter at continuous lower ovoid edge 11 which rests upon roof 64. However other embodiments of my pluming vent cover 1 comprise continuous lower edges which are not ovoid in shape. Upper circular continuous edge 8 is preferably approximately five inches in diameter, but need not be circular in other embodiments. Cone-shaped base 5 in the preferred embodiment is approximately fifteen inches in maximum perpendicular height from lower ovoid edge 11 to upper continuous circular edge 8. Stiff flexible metal sheet 13, of which cone-shaped base 5 is made, is approximately one millimeter in thickness.

Referring to FIGS. 2 and 4, cone-shaped base 5 has an interior base surface 13*a* and an exterior base surface 13*b*, each of which correspond respectively to the exterior and interior surfaces of flexible metal sheet 13. As seen in FIGS. 1 and 2, along shorter longitudinal length 14 (approximately 13.5 inches and corresponding to upper side of roof 64) of cone-shaped base 5 is longitudinal hem 16. Longitudinal hem 16 comprises a first sheet edge 18*a* and a second sheet edge 18*b*. First sheet edge 18*a* bends backward upon itself, as does second sheet edged 18*b* after severing to form cone-shaped base 5.

The roofer manually flattens each bent sheet edge 18*a*, 18*b* to form continuous longitudinal hem 16. The stiffness of metal sheet 13 (of which cone-shaped base 5 is made) maintains flattened longitudinal hem 16 in place without requiring mechanical fasteners or other attachments. Cone-shaped base 5 can be of other dimensions, shapes and sizes in other embodiments. Other embodiments need not comprise longitudinal hem 16, but they require mechanical fasteners or appropriate adhesives.

First and Second Rounded Metal Straps 6, 7 in the Preferred Embodiment

Referring now to FIGS. 4 and 5, attached to upper circular continuous edge 8 is first rounded metal strap 6. First rounded metal strap 6 is approximately eight inches in length when fully extended, one inch in width and one millimeter in thickness. Each first rounded metal strap 6 has a first strap end 6*a*, a second strap end 6*b*, an upper first surface 6*c* and a lower first surface 6*d*. First rounded metal strap 6 attaches to upper circular continuous edge 8 with a first upper pop rivet 9*a* at first strap end 6*a* and a second upper pop rivet 9*b* at second strap end 6*b*. Each respective upper pop rivet 9*a*, 9*b* attaches through first and second upper rivet apertures 20*a*, 20*b* respectively within first rounded metal strap 6, as well as congruent first and second strap apertures 21*a*, 21*b* respectively within cone-shaped base 5.

Riveted first strap end 6*a* opposes riveted second strap end 6*b* along upper circular continuous edge 8 at approximately 180 degrees. First rounded metal strap 6 is preferably made of the same metal sheet material as that used for cone-shaped base 5, and each strap 6 is greater in length than width. However, in other embodiments first rounded metal strap 6 can be of other lengths, widths, thickness, and materials with appropriate flexibility and stiffness.

Still referring to FIGS. 4 and 5, also attached to upper circular continuous edge 8 is second rounded metal strap 7. In the preferred embodiment, second rounded metal strap 7 is also approximately eight inches in its fully extended length, one inch in length and one millimeter in thickness. Each second rounded metal strap 7 has a third strap end 7*a*, a fourth strap end 7*b*, an upper second surface 7*c* and a lower second surface 7*b*. Second rounded metal strap 7 attaches to upper circular continuous edge 8 with third pop rivet 9*c* at first strap end 7*a* and fourth pop rivet 9*d* at second strap end 7*b*.

Each third and fourth pop rivet 9*c*, 9*d* respectively inserts through third and fourth rivet apertures 22*a*, 22*b* respectively within metal strap 7, and congruent third and fourth cone apertures 23*a*, 23*b* respectively within hollow cone-shaped base 5. Riveted third strap end 7*a* opposes riveted fourth strap end 7*b* along upper circular continuous edge 8 at approximately 180 degrees. FIG. 4. Second rounded metal strap 7 is preferably of the same metal sheet material as that used to create cone-shaped base 5. However, in other embodiments second rounded metal strap 7 can be of other lengths, widths and thickness, as well as made with other materials with appropriate flexibility and stiffness.

As best seen in FIG. 5, first rounded strap end 6*a* is approximately 90 degrees along upper circular continuous edge 8 from adjoining third and fourth rounded strap ends 7*a*, 7*b* respectively. Third rounded strap end 7*a* is also approximately 90 degrees from first and second rounded strap ends 6*a* and 6*b* respectively. Each rounded metal strap 6, 7 has maximum vertical height in its bent configuration at first and second central strap points 6*e*, 7*e* respectively. At points 6*e*, 7*e* each strap 6, 7 respectively contacts the other, with first rounded strap 6*a* crossing over second rounded strap 7 at midpoints 6*e*, 7*e*. However, in other embodiments second rounded metal strap 7*a* can cross over first rounded metal strap 6, and rounded metal straps 6, 7 can adjoin each other at other angles along upper continuous circular edge 8.

Figure 11:
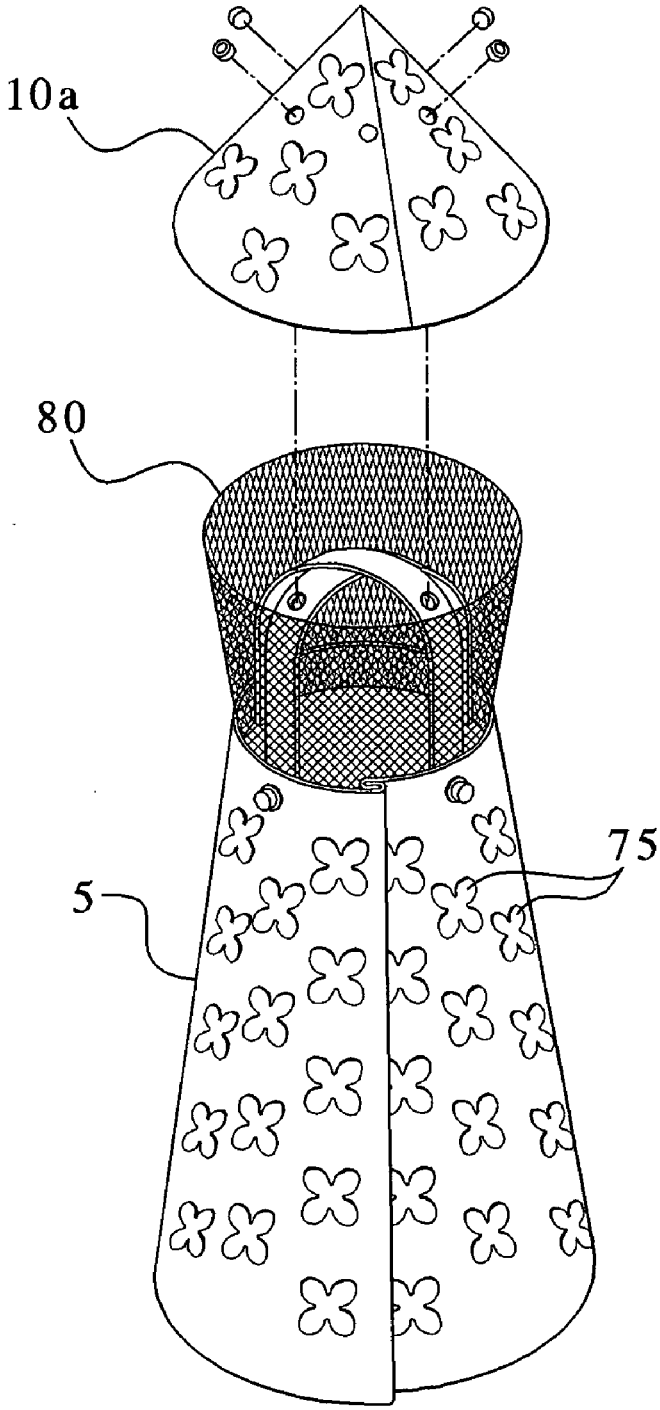
FIG. 11 is a partial perspective view of the pluming vent cover with a screen panel and embossed design.

First and second rounded metal straps 6, 7 are preferably made from flat metal sheets 13 which are the same color and materials as cone-shaped base 5. However, in other embodiments rounded metal straps 6, 7 can be other colors, bear diverse embossed designs, and comprise glazed or enamel finishes. FIG. 11. In other embodiments there are additional rounded metal straps which attach to upper continuous circular edge 8. Also in other embodiments, diverse mechanical or other attachments replace pop rivets. 9*a*, 9*b*, 9*c*, 9*d*.

Upper Pyramidal Cap 10*a* in the Preferred Embodiment

Referring now to FIGS. 2, 3 and 4, attached to first and second rounded metal straps 6, 7 respectively is upper pyramidal cap 10*a*. Upper pyramidal cap 10*a* is circular in horizontal cross-section, and forms a shallow approximately rounded pyramidal in three dimensions. Cap 10*a* has a lower continuous pyramidal edge 34 of approximately 30 inches circumference, and cap 10*a* is approximately four inches in perpendicular height through pyramidal apex 40. Lower continuous pyramidal base edge 34 has a diameter of approximately ten inches, and is approximately one millimeter in thickness. However, in other embodiments an upper cap 10 can be of other shapes, sizes and thickness.

As best seen in FIG. 4, upper pyramidal cap 10*a* has an upper exterior surface 10*b* and a lower interior surface 10*c*. As seen in FIG. 3, approximately three inches above lower continuous pyramidal edge 34 are four equidistantly spaced first, second, third and fourth pyramidal pop rivets 30*a*, 30*b*, 30*c*, 30*d* respectively (generically pyramidal pop rivets 30). First and third pyramidal pop rivets 30*a*, 30*c* respectively attach first rounded metal strap 6 to upper pyramidal cap 10*a*. Similarly, second and fourth pyramidal pop rivets 30*b*, 30*d* respectively attach rounded metal strap 7 to upper pyramidal cap 10*a*. All pop rivets 30*a*, 30*b*, 30*c*, 30*d* fit within upper pyramidal pop rivets apertures (not seen). In other embodiments, first and second rounded straps 6, 7 attach to upper pyramidal cap 10 by diverse mechanical devices or adhesives.

As seen in FIGS. 2 and 5, rigid first and second rounded metal straps 6, 7 define a pre-determined spaced interval 95 between upper pyramidal cap 10*a* and upper continuous circular edge 8. This interval is approximately four and one-half inches in height in the preferred embodiment. The material of which rounded metal straps 6, 7 are made must be sufficiently stiff to support upper pyramidal cap 10*a* at this height. However, this same material must also be sufficiently flexible to manually bend to the desired rounded strap configuration.

Figure 6:
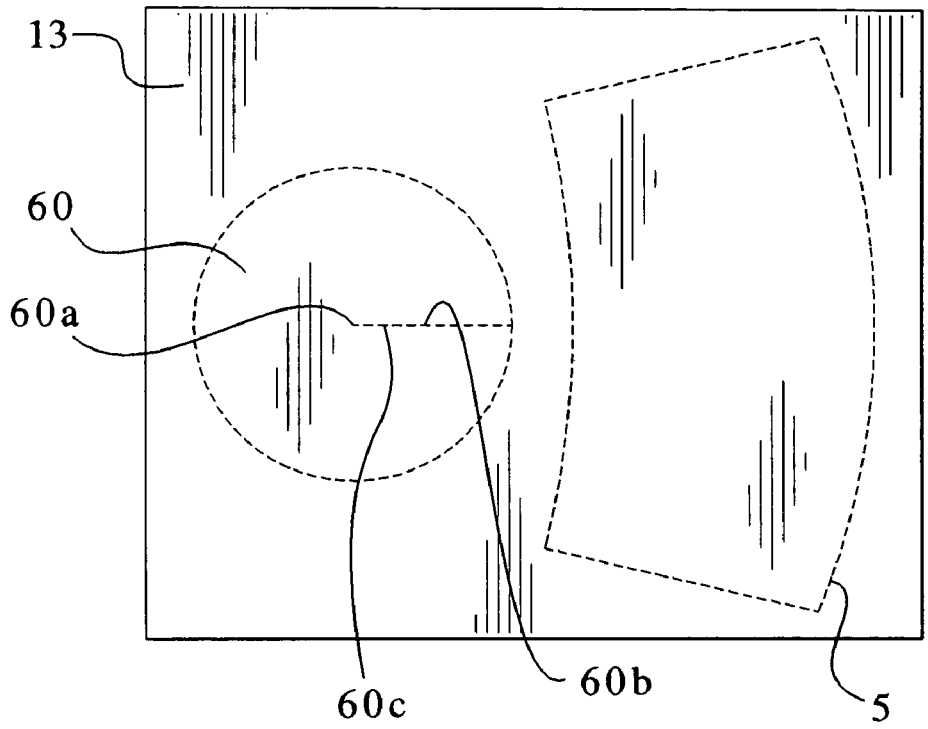
FIG. 6 illustrates the outlined upper pyramidal cap and lower hollow pyramidal cone-shaped base to be severed and cut from a flat metal sheet.
Figure 9:
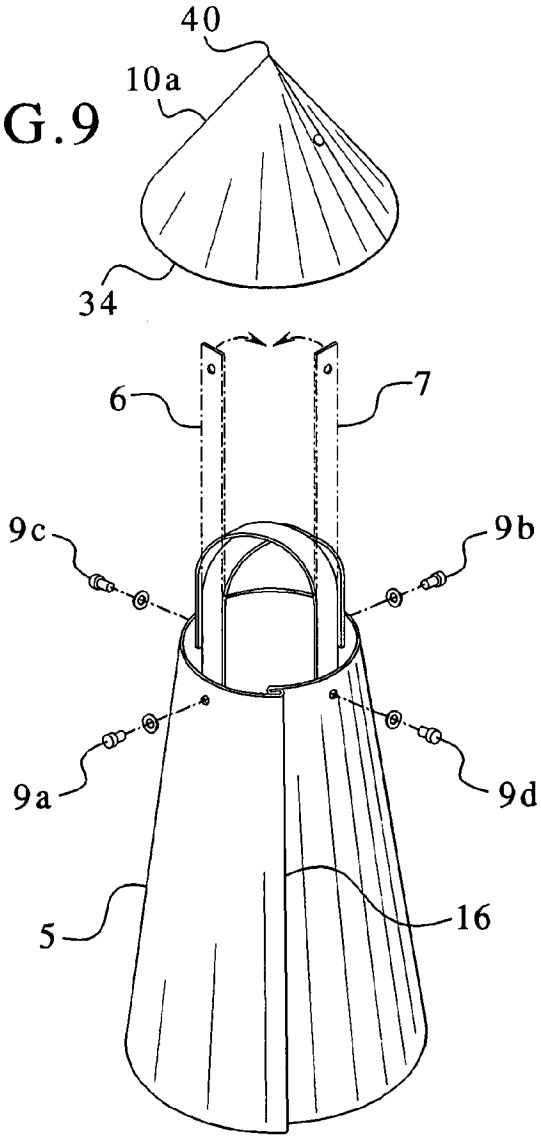
FIG. 9 is an exploded view of lower hollow cone-shaped base with attached previously straight, rounded metal straps and upper pyramidal cap.
Figure 8:
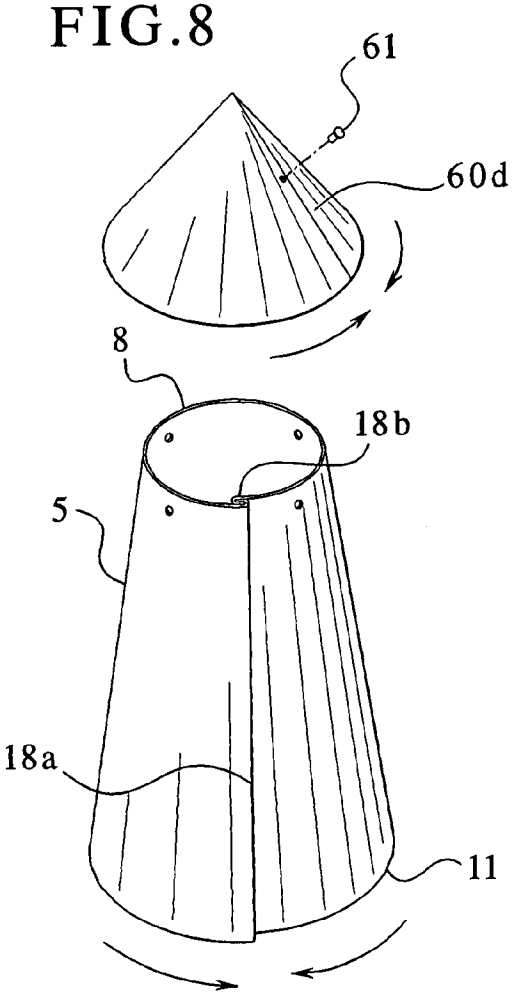
FIG. 8 illustrates the method of folding flexible severed metal sheets into a hollow cone-shaped base and an upper pyramidal cap attached with one rivet.

The roofer creates upper pyramidal cap 10*a* by severing an appropriately sized circular section 60 from a stiff metal sheet. FIG. 6. The roofer then cuts a straight line to the center point 60*a* of circular section 60 (i.e., a radius), thereby forming first and second circular component longitudinal edges 60*b*, 60*c* respectively. FIG. 3. The roofer then folds circular component longitudinal edge 60*b* over circular component longitudinal edge 60*c*. FIG. 8. He or she thereby forms continuous longitudinal seam 60*d* which is continuously straight from circular lower edge 34 to cap apex 40. FIGS. 3 and 9. Continuous longitudinal seam 60*d* is held in this overlapping alignment by a single seam pop rivet 61, through first and second congruently aligned seam pop rivet apertures 61*a*, 61*b* (not seen). Please see FIGS. 3 and 9. However, in other embodiments there are additional pop rivets 61 or other kinds of mechanical fasteners or adhesives.

The operator creates a pluming vent cover 1 as follows:

Cone-Shaped Base 5

Figure 7:
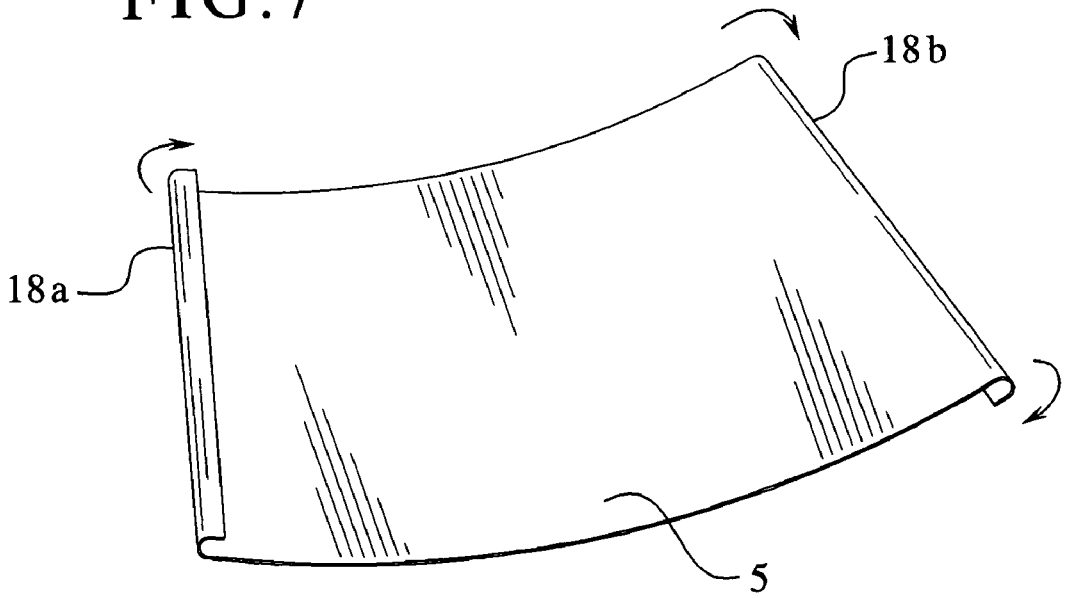
FIG. 7 illustrates the method of folding the edges of the severed metal sheet of FIG. 6 to form the longitudinal hem of the hollow cone-shaped base.

The roofer begins with one flat metal sheet 13 which he or she marks for severing according to roof specifications to create cone-shaped base 5. FIG. 6. The roofer severs metal sheet 13 along these marks, so metal sheet 13 becomes a modified integral metal piece with a first sheet edge 18*a* and a second sheet edge 18*b*. FIG. 7. If stiff metal sheet 13 is sufficiently large, then more than one cone-shaped base 5 can be cut from one stiff metal sheet 13. If pluming vent cover 1 is not created on-site, a manufacturer uses a single large metal sheet to produce numerous cone-shaped bases 5 which are not yet folded or comprising longitudinal hems 16. This approach is recommended for numerous buildings which are uniform in roof design, slope pitch, shingle thickness and arrangement (such as row houses or a housing development with one roof plan and identical roof materials and shingles).

In the best mode and on-site, the roofer next bends first sheet edge 18*a* backwards upon itself to form a first bent edge width of approximately ⅝ (five-eighths) inch. FIG. 7. He or she then bends second sheet edge 18*b* backwards upon itself to create a second bent edge width of approximately ⅜ (three-eighths) inch. Please see FIG. 8. Second bent edge 18*b* is then hooked around first bent sheet edge 18*a* along their entire respective longitudinal lengths, thereby forming longitudinal hem 16. FIGS. 5, 8 and 9.

An important advantage of this technique is the absence of rough metal edges on which the roofer can injure himself or herself. Each bent sheet edge 18*a*, 18*b* forms an exposed first exterior longitudinal fold 19*a* or a second interior longitudinal fold 19*b* respectively. These longitudinal folds 19*a*, 19*b* are sufficiently rounded and have a sufficiently smooth surface that the roofer's fingers will not catch on a jagged severed metal edge. FIG. 5.

Attachment of Rounded Metal Straps 6, 7 and Upper Pyramidal cap 10*a*

Figure 10:
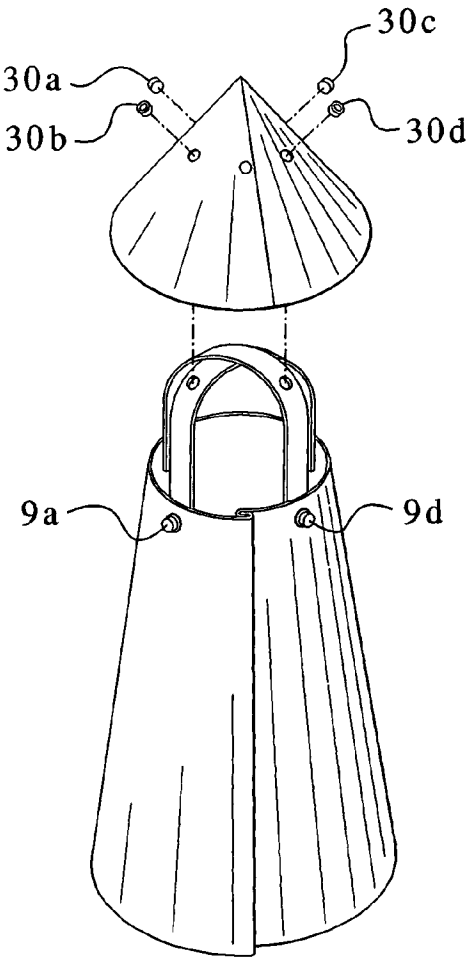
FIG. 10 is an exploded view of upper pyramidal cap attaching to the rounded metal straps with rivets.

The roofer next takes two originally straight stiff metal straps 6, 7, and manually bends each strap 6, 7 to the appropriate rounded configuration for attachment to both upper pyramidal cap 10*a* and cone shaped base 5. Please see FIG. 9. He or she next attaches both metal straps 6, 7 with upper pop rivets 9*a*, 9*b*, 9*c*, 9*d* respectively to upper circular continuous edge 8. FIG. 9. He or she then attaches upper pyramidal cap 10*a* to first and second metal straps 6, 7 using pyramidal pop rivets 30*a*, 30*b*, 30*c*, 30*b*. FIG. 10. However, in other embodiments more or fewer pop rivets are satisfactory, as are other mechanical fasteners and adhesives.

The operator then places the entire pluming vent cover 1 over pluming vent pipe 54*a*, base 54*b*, roof flashing 54*c* and washer 54*d* along roof 64. Please see FIG. 1. As best seen in FIG. 2, the length of cone-shaped base 5 from ovoid continuous base edge 11 to upper continuous circular base edge 8 is greater along lower roof side 55*a* than upper side 64*a*. The operator places caulk 70 to seal ovoid continuous base edge 11 to roof 64, as well as to abutting shingles 64*a* in appropriate cases. FIG. 1. In other embodiments the operator places a screen panel 80 along upper circular edge 8 prior to placement along roof 64. FIG. 11.

Preferably, the diameter of lower continuous ovoid edge 11 is approximately 28 inches for a pluming vent pipe 54*a* which is approximately three inches in length. Similarly, lower continuous ovoid base edge 11 has an approximate 32 inch diameter when pluming vent pipe 54*a* is approximately four inches in length. The trimming of lower continuous ovoid edge 11 to fit roof 64 does not fit a straightforward ratio, but instead empirically results in lower ovoid continuous edge 11 extending different distances from upper continuous circular edge 8. The exact points along which cone-shaped base 5 is severed to fit each roof pitch is marked upon the original stiff metal sheet 13. As roof pitches vary and roofing shingles contribute their own slope, the initial sheet metal measurement for a correctly aligned lower ovoid continuous edge 11 should accommodate these variables.

The above is a description for the preferred embodiment of my pluming vent cover 1, as well as the best mode of its application. However, those skilled in the art may envision other possible variations with the invention's scope, by changing the dimensions and shapes of its components. According, since my invention is possible in other specific forms without departing from the spirit or essential characteristics thereof. Instead, the embodiments described herein are considered in all respects illustrative and not restrictive. All changes which come within the meaning and range of equivalency of the claims are intended to be included therein.

What is claimed is:

1. A pluming vent cover comprising:

A. a three-dimensional base, said base comprising a height and a diameter, said three-dimensional base further comprising a lower continuous edge and an upper continuous edge, said three-dimensional base comprising an interior surface and an exterior surface, B. a plurality of rounded metal straps, each said rounded metal strap comprising two ends, each said rounded metal strap further comprising an upper surface and a lower surface, a width, thickness and length, each metal strap further comprising a mid-line through said length, said length comprising the greatest dimension of each said metal rounded strap, C. an upper cap, said cap comprising an upper surface and a lower surface, said cap further comprising an apex and a continuous cap lower edge, said three-dimensional base attaching to said upper cap by said rounded metal straps, said vent cover attaching to a roof and enclosing a pipe, thereby concealing said pipe from observation, said three-dimensional base being approximately cone-shaped and said upper cap being pyramidal in shape, said lower continuous edge comprising a lower continuous ovoid edge and said upper edge comprising an upper circular continuous edge, said cone-shaped base further comprising a continuous longitudinal hem, said cone-shaped base severed from an integral metal sheet, said pluming vent cover comprising two rounded rigid metal straps, said first rounded metal strap attaching to said upper circular continuous edge by respective first and second strap ends, said second rigid rounded metal strap attaching to said upper circular continuous edge by respective third and fourth strap ends.

2. The pluming vent cover as described in claim 1 wherein said first and second rounded rigid metal straps attach to said upper circular continuous edge by pop rivets.

3. The pluming vent cover as described in claim 2 wherein said first and second rounded metal straps attach to said upper pyramidal cap by pop rivets.

4. The pluming vent cover as described in claim 3 wherein said longitudinal hem comprises two longitudinal folds.

5. The pluming vent cover as described in claim 4 wherein said pluming vent cover comprises screen panels.

6. The pluming vent cover as described in claim 5 wherein said spaced interval between said upper continuous circular edge and said lower continuous pyramidal edge is approximately 4.5 inches.

7. The method of assembly for a pluming vent cover comprising the steps of:

a. severing a stiff flat metal sheet to create a hollow cone-shaped base, said hollow cone-shaped base comprising a maximum longitudinal height, an upper diameter, a lower diameter and a thickness, said hollow cone-shaped base further comprising an upper circular continuous edge and a lower ovoid continuous edge, a first sheet edge and a second sheet edge, b. bending said first sheet edge back upon itself and bending said second sheet edge back upon itself to produce a first longitudinal fold and a second longitudinal fold respectively, each said longitudinal fold consisting solely of smooth edges, c. hooking said second longitudinal fold around said first longitudinal fold, d. manually flattening each said longitudinal fold to create a longitudinal hem, said longitudinal hem comprising no mechanical fasteners, e. bending a first rounded metal strap and a second rounded metal strap to a rounded configuration, said first rounded metal strap comprising first and second respective ends and said second rounded metal strap comprising third and fourth respective ends, f. attaching said rounded metal straps to said upper circular continuous edge of said hollow cone-shaped base by their respective ends, g. severing a section from a stiff metal sheet and then severing a straight line to the center point of said section, thereby creating a first circular component longitudinal edge and a second circular longitudinal edge, h. forming a continuous longitudinal seam by placing said first circular component longitudinal edge and said second longitudinal edge in overlapping alignment, said continuous longitudinal seam held in place with a single seam pop rivet within first and second congruently aligned seam pop rivet apertures, said overlapping alignment creating an upper pyramidal cap, i. inserting four pyramidal pop rivets through corresponding pop rivet apertures within said rounded straps and said upper pyramidal cap, said pop rivets attaching said two rounded metal straps to said upper pyramidal cap, said rounded straps creating a spaced interval between said hollow cone-shaped base and said upper pyramidal cap.

8. The method of assembly for said pluming vent cover as described in claim 7 wherein a plurality of hollow cone-shaped bases are severed from a single stiff metal sheet.

9. The method of assembly for said pluming vent cover as described in claim 7 wherein said assembled pluming vent cover is embossed with an ornamental design.

10. The method of assembly of said pluming vent cover as described in claim 7 wherein said hollow cone-shaped base and said upper pyramidal cap consist of copper and steel, said hollow cone-shaped base and said upper pyramidal cap being approximately one millimeter in thickness.

11. The method of assembly for creating said pluming vent cover as described in claim 7 wherein said pluming, spaced interval between said upper pyramidal cap and said hollow cone-shaped base is approximately four and one-half inches in height.

12. The method of assembly for said pluming vent cover as described in claim 7 wherein said lower continuous ovoid base has an approximate 32 inch diameter when the enclosed pluming vent pipe is approximately four inches in length.

13. The method of assembly for said pluming vent cover as described in claim 7 wherein said lower continuous ovoid base edge attaches to said roof and shingles with caulk.

14. The method of assembly for said pluming vent cover as described in claim 7 wherein said lower continuous ovoid edge is severed to closely fit a pre-determined roof slope, said longitudinal height of said hollow cone-shaped base from said lower continuous ovoid base edge to said upper continuous circular base edge being greater along the lower roof side than the upper roof side, said lower continuous ovoid edge measured to fit said roof slope prior to said severing of said lower continuous ovoid edge.

15. A pluming vent cover as described in claim 1, wherein said diameter of said lower continuous ovoid edge is approximately 28 inches for a pluming vent pipe which is approximately three inches in length.

* * * * *